US007585552B2

(12) United States Patent
Meseke

(10) Patent No.: US 7,585,552 B2
(45) Date of Patent: Sep. 8, 2009

(54) APPARATUS AND METHOD OF ASSEMBLING AN ARTIFICIAL TREE AND TABLE SURFACE DECORATION ASSEMBLY

(76) Inventor: Melinda Joanne Meseke, 148 Oak Hill Dr., Maryville, IL (US) 62062

( * ) Notice: Subject to any disclaimer, the term of this patent is extended or adjusted under 35 U.S.C. 154(b) by 0 days.

(21) Appl. No.: 11/686,721

(22) Filed: Mar. 15, 2007

(65) Prior Publication Data

US 2007/0215013 A1 Sep. 20, 2007

Related U.S. Application Data

(60) Provisional application No. 60/783,755, filed on Mar. 17, 2006.

(51) Int. Cl.
*A47G 33/06* (2006.01)

(52) U.S. Cl. ..... 428/19; 29/469; 108/50.12; 211/196; 211/205; 362/123; 428/18; 428/20

(58) Field of Classification Search ..... 156/61; 211/196, 205; 362/123; 446/73; 428/18, 428/19, 20; 135/16; 108/50.11, 50.12; *A47G 33/06*
See application file for complete search history.

(56) References Cited

U.S. PATENT DOCUMENTS

| | | | | |
|---|---|---|---|---|
| 735,010 | A | 7/1903 | Zahl | |
| 2,849,601 | A | 8/1958 | Walzer | |
| 3,096,943 | A | 7/1963 | Forrer | |
| 3,624,732 | A | 11/1971 | Bowden | |
| 3,647,605 | A | 3/1972 | Spiegel | |
| 3,692,617 | A | 9/1972 | Marks et al. | |
| 3,746,601 | A | 7/1973 | Strony | |
| 3,871,143 | A | 3/1975 | Quick | |
| 4,061,306 | A | 12/1977 | Taylor | |
| 4,353,659 | A | 10/1982 | Comte | |
| D269,771 | S | 7/1983 | Williams | |
| D276,322 | S | 11/1984 | Maxwell et al. | |
| 4,612,218 | A | 9/1986 | Enterline | |
| 4,734,301 | A | 3/1988 | McKinney | |
| D298,519 | S | 11/1988 | Nackers | |
| 4,847,123 | A * | 7/1989 | Armstead et al. | 428/9 |
| 5,037,049 | A | 8/1991 | Funk | |
| 5,189,982 | A | 3/1993 | Liu | |
| 5,550,720 | A * | 8/1996 | Carroll | 362/123 |
| 5,758,948 | A | 6/1998 | Hale | |
| 5,776,559 | A * | 7/1998 | Woolford | 428/18 |
| 6,350,042 | B1 | 2/2002 | Lai | |
| 6,360,675 | B1 | 3/2002 | Jones | |
| 6,554,012 | B2 * | 4/2003 | Patarra | 135/16 |
| 6,974,227 | B2 | 12/2005 | Tsai | |
| 7,017,598 | B2 * | 3/2006 | Nipke | 135/16 |
| D531,539 | S | 11/2006 | Barthelmess | |

(Continued)

*Primary Examiner*—John J. Zimmerman
*Assistant Examiner*—Aaron Austin
(74) *Attorney, Agent, or Firm*—Armstrong Teasdale LLP

(57) ABSTRACT

A decoration assembly is provided. The decoration assembly includes a tree and a support member coupled to the tree. The support member includes an interior surface and an opposite exterior surface. The interior surface defines a cavity within the support member. The support member further includes an electrical distribution system positioned within a portion of the cavity. The decoration assembly further includes a secondary support member including at least three legs. The secondary support member substantially circumscribes the support member. A method of assembly is also provided.

15 Claims, 3 Drawing Sheets

U.S. PATENT DOCUMENTS

D539,188 S * 3/2007 Barthelmess ..... D11/118
D540,064 S * 4/2007 Barthelmess ..... D6/397
D541,038 S * 4/2007 Barthelmess ..... D3/6
D541,550 S * 5/2007 Barthelmes ..... D6/397
D549,613 S * 8/2007 Barthelmess ..... D11/118
2004/0200391 A1 10/2004 Poo
2005/0048226 A1 3/2005 Gary et al.
2006/0186300 A1 8/2006 Everett et al.
2007/0041179 A1 * 2/2007 Barthelmess ..... 362/123
2007/0246091 A1 * 10/2007 Becker ..... 135/16
2009/0029075 A1 * 1/2009 Barthelmess ..... 428/19

* cited by examiner

APPARATUS AND METHOD OF ASSEMBLING AN ARTIFICIAL TREE AND TABLE SURFACE DECORATION ASSEMBLY

CROSS REFERENCE TO RELATED APPLICATIONS

This application claims priority to, and the benefit of, the filing date of U.S. Provisional Application No. 60/783,755 filed on Mar. 17, 2006, the contents of which are hereby incorporated by reference.

BACKGROUND OF THE INVENTION

This invention relates generally to decoration assemblies, and more particularly to decoration assemblies adapted to be used in conjunction with a support structure.

Decoration assemblies such as Christmas trees for example, are often used during various times of the year. For example, decoration assemblies may be used as seasonal displays or may be displayed during a particular holiday season. As such, generally decoration assemblies are usually only displayed for a portion of the year and are then stored for future use. Storage of at least some known decoration assemblies can create a challenge. In particular, because at least some known decoration assemblies are large and inflexible, such decoration assemblies may be difficult or awkward to move and may take up a significant amount of storage space. Moreover, because of their construction, design, or size, at least some known decoration assemblies may be difficult to assemble. For example, a Christmas tree decoration may include a plurality of limbs that must be coupled to, or removed from, a central support member when the tree is assembled or disassembled. Depending on the size, orientation, and number of limbs it may be a tedious and time consuming task to assemble or disassemble such trees. For example, at least some known Christmas tree decorations include a plurality of limbs that are threadably coupled to the central support member.

Additionally, at least some known free-standing decoration assemblies may be unstable when assembled. For example, at least some known Christmas tree decorations may require a Christmas tree be positioned within a stand. However, if the Christmas tree is not positioned correctly within the stand and/or if the stand is not securely coupled to the tree, the Christmas tree may easily tip over.

Furthermore, at least some known decoration assemblies are large and cannot be used in conjunction with a support structure. For example, because of their size or weight, known Christmas tree decorations must be coupled to a stand designed for such a decoration, that is supported on a flat surface such as the ground or a table top, but such trees may not be used in conjunction with an alternative stand or with a support structure that enhances the assembly, storage, and stability of the decoration assembly.

BRIEF DESCRIPTION OF THE INVENTION

In one aspect of the present invention, a decoration assembly includes an artificial tree including a plurality of arms, wherein each arm is independently rotatable from a storage position to an erect position, and a support member coupled to the tree. The support member includes an interior surface and an opposite exterior surface. The interior surface defines a cavity within the support member. The support member further includes an electrical distribution system configured to be positioned within a portion of the cavity. The decoration assembly further includes a secondary support member including a table surface, an opening through the table surface, and at least three legs coupled to the table surface. The support member is configured to extend through the opening such that the secondary support member substantially circumscribes the support member.

In another aspect of the present invention, a method of assembly includes providing an artificial tree including a plurality of arms, wherein each arm is independently rotatable from a storage position to an erect position, and coupling a support member to the tree. The support member includes an interior surface and an opposite exterior surface wherein a cavity is defined with the support structure. The method further includes positioning an electrical distribution system within a portion of the cavity and coupling a secondary support member having a table surface, an opening through the table surface, and at least three legs coupled to the table surface, to a portion of the support member such that the support member extends through the opening and the secondary support member substantially circumscribes the support member.

DETAILED DESCRIPTION OF THE INVENTION

Figure 1:
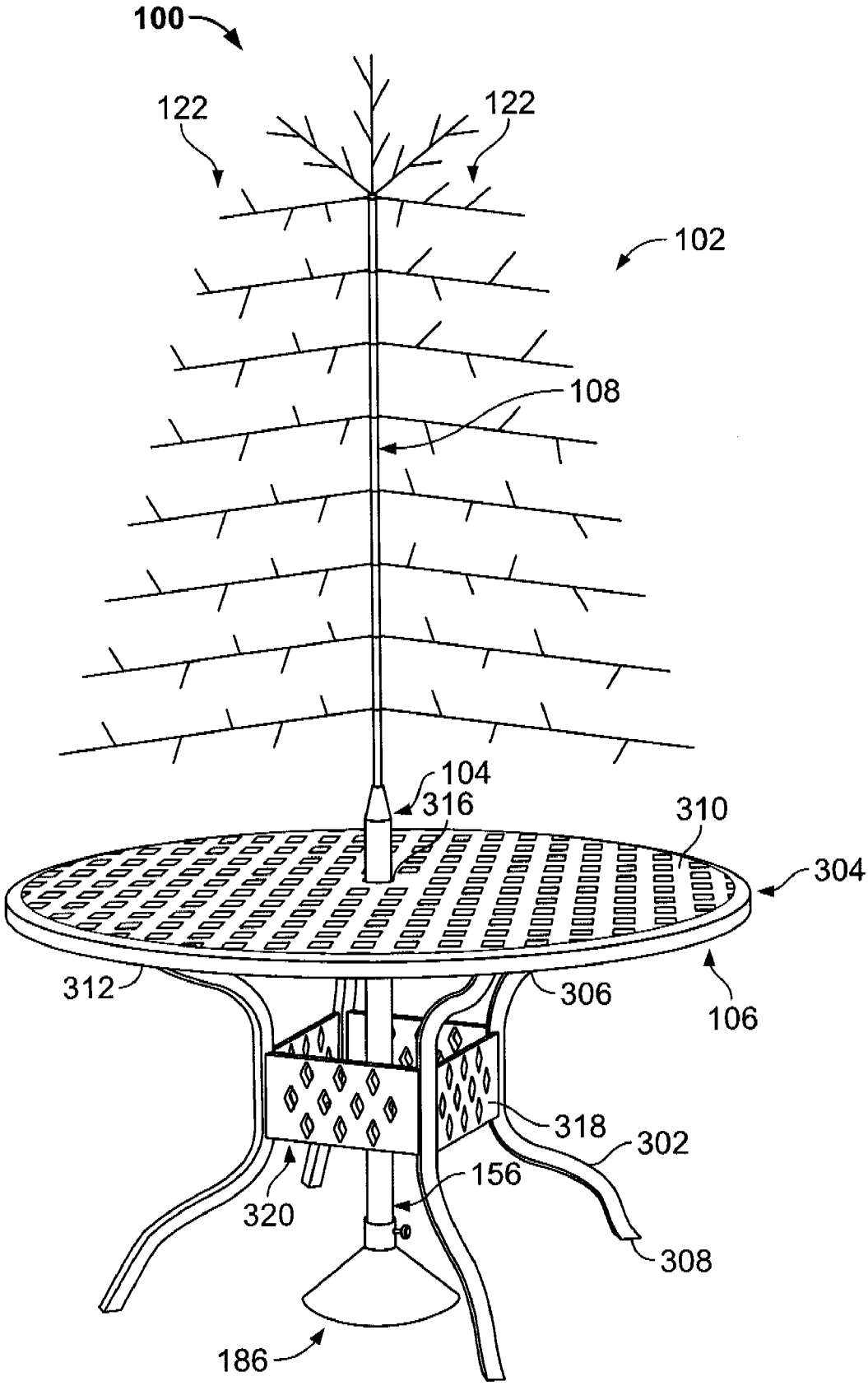
FIG. 1 is a perspective view of an exemplary decoration assembly.
Figure 2:
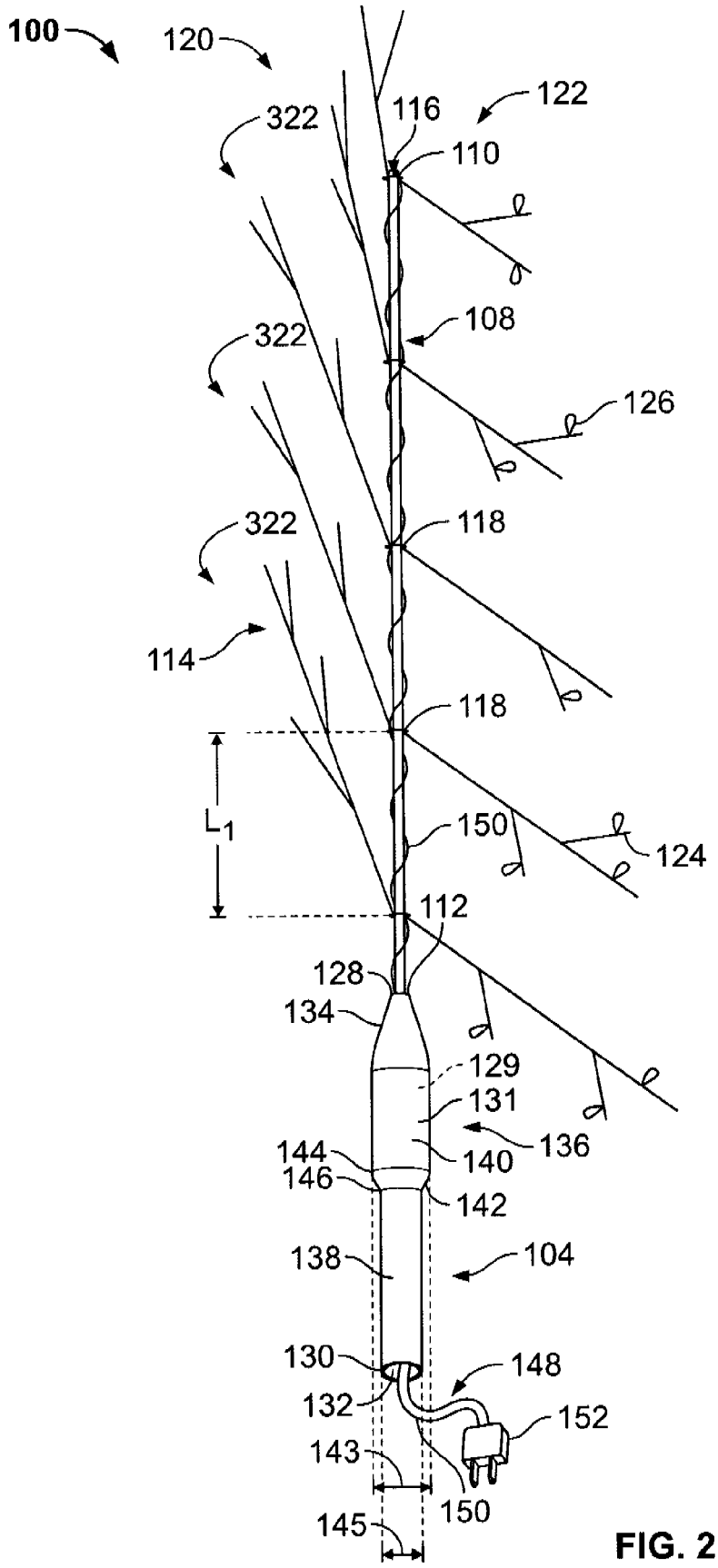
FIG. 2 is a perspective view of a tree and an exemplary support member that may be used with the decoration assembly shown in FIG. 1.
Figure 3:
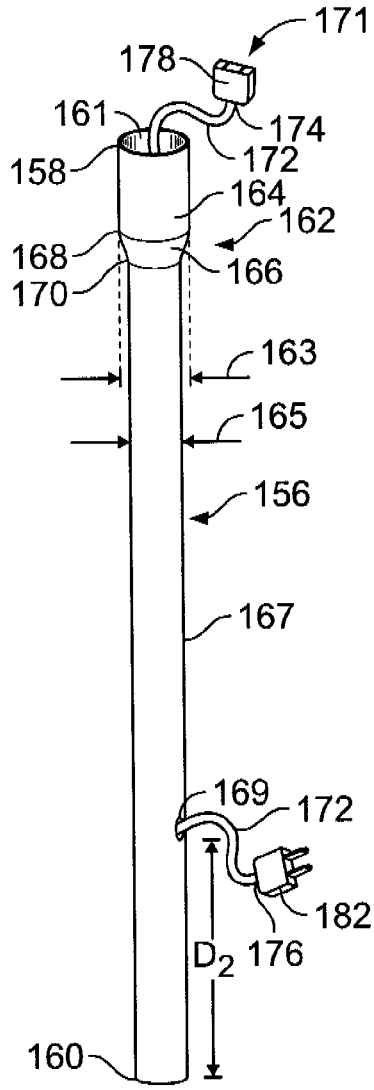
FIG. 3 is a perspective view of an exemplary support post that may be used with the decoration assembly shown in FIG. 1.
Figure 4:
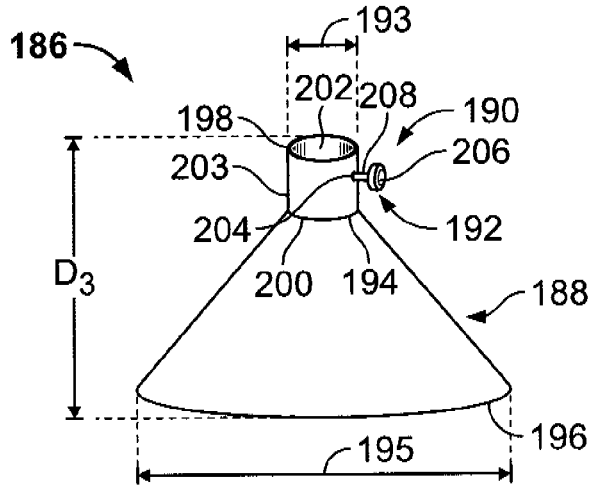
FIG. 4 is a perspective view of an exemplary base assembly that may be used with the decoration assembly shown in FIG. 1.

FIG. 1 is a perspective view of an exemplary decoration assembly 100. FIG. 2 is a perspective view of a tree and an exemplary support member 104 that may be used with decoration assembly 100. FIG. 3 is a perspective view of an exemplary support post 156 that may be used with decoration assembly 100. FIG. 4 is a perspective view of an exemplary base assembly 186 that may be used with assembly 100. In the exemplary embodiment, decoration assembly 100 includes a tree 102, a support member 104 coupled to tree 102, and a secondary support member 106 that circumscribes support member 104, as described in more detail herein.

In the exemplary embodiment, tree 102 includes a central support shaft 108 that has a radially outer first end 110, an opposite, radially inner end 112, and a plurality of arms 114 that extend outwardly from support shaft 108. In the exemplary embodiment, support shaft 108 is a tubular member that includes a cavity 116 defined therein and extending from end 110 to end 112. In the exemplary embodiment, shaft 108 is fabricated from a metallic material. Alternatively, shaft 108 may have any cross-sectional shape and/or be fabricated from any material that enables shaft 108 to function as described herein, such as, but not limited to a plastic, a carbon graphite material, and/or any combination thereof.

In the exemplary embodiment, arms 114 are spaced axially along shaft 108 such that axially-adjacent arms 114 are separated by an axial distance $L_1$. In the exemplary embodiment, each arm 114 is coupled to shaft 108 using at least one fastening mechanism 118. More specifically, in the exemplary embodiment, each fastening mechanism 118 is a bearing that allows each arm 114 to rotate from a storage position 120 (shown in FIG. 2) to a display position 122 (shown in FIG. 1). In an alternative embodiment, fastening mechanism 118 is any mechanism that enables decoration assembly 100 to function as described herein. In another embodiment, at least some of arms 114 are removably coupled to shaft 108.

In the exemplary embodiment, each arm 114 includes at least one branch 124 extending outward therefrom, and at least one light-emitting device 126 coupled thereto. In an alternative embodiment, each arm 114 does not include at least one branch 124 and/or does not include at least one light-emitting device 126.

As described above, decoration assembly 100 includes support member 104. In the exemplary embodiment, support member 104 is a hollow, tubular member that includes a first end 128 and an opposite second end 130. Support member first end 128 is coupled to shaft second end 112. In the exemplary embodiment, support member first end 128 extends from shaft second end 112 and member 104 is formed integrally with shaft 108. In an alternative embodiment, support member first end 128 is removably coupled and/or is rotatably coupled to shaft second end 112.

In the exemplary embodiment, support member 104 includes an interior surface 129 and an opposite exterior surface 131. Interior surface 129 defines a cavity 132 that extends through at least a portion of support member 104. In the exemplary embodiment, support member 104 includes a transition portion 134 extending from first end 128 towards second end 130, a stop portion 136 that extends from transition portion 134, and a coupling portion 138 that extends from stop portion 136 to second end 130. In the exemplary embodiment, transition portion 134, stop portion 136, and coupling portion 138 are formed integrally together. In an alternative embodiment, transition portion 134, stop portion 136, and coupling portion 138 are coupled together. In an alternative embodiment, support body member 104 does not include transition portion 134. Rather, support member 104 includes stop portion 136 and coupling portion 138 extending therefrom.

In the exemplary embodiment, stop portion 136 includes a first body portion 140 and a second portion 142 extending from first body portion 140. In the exemplary embodiment, second body portion 142 has a frusto-conical cross-sectional profile defined by a first diameter 143 at a first end 144 and a second diameter 145 at a second end 146. In the exemplary embodiment, first diameter 143 is larger than second diameter 145. In an alternative embodiment, second diameter 145 is greater than first diameter 143. In another alternative embodiment, second portion 142 is formed with any suitable shape that enables support member 104 to function as described herein. In a further alternative embodiment, support member 104 does not include first portion 140, but rather support member 104 includes only second portion 142.

Moreover, in the exemplary embodiment, decoration assembly 100 is coupleable to an electricity source (not shown) through an electrical connector assembly 148. Connector assembly 148 enables electricity to be supplied to light-emitting devices 126. In the exemplary embodiment, assembly 148 includes a wire 150 including at least one male connector 152. Alternatively, wire 150 may be formed with a female connector.

In the exemplary embodiment, wire 150 extends through support member 104 and is helically wrapped around at least a portion of shaft 108. Specifically, a portion of electric wire 150 extends through cavity 132 such that connector 152 extends beyond second end 130 of support member 104. In an alternative embodiment, an electrical source is coupled to shaft 108 in any suitable manner that enables decoration assembly 100 to function as described herein.

Decoration assembly 100 also includes a support post 156 that is configured to couple to support member 104 and extend therefrom. In the exemplary embodiment, support post 156 includes a first end 158, an opposite second end 160, and a cavity 161 that extends therethrough from first end 158 to second end 160. Moreover in the exemplary embodiment, post 156 is fabricated from a metallic material. In an alternative embodiment, post 156 may be fabricated with any shape or from any material such as, but not limited to a plastic material, a carbon graphite material, and/or any combination thereof, that enables decoration assembly 100 to function as described herein.

Moreover, in the exemplary embodiment, support post 156 includes a coupling portion 162. In the exemplary embodiment, support post 156 and coupling portion 162 are formed integrally. In an alternative embodiment, support post 156 and coupling portion 162 are coupled together.

In the exemplary embodiment, coupling portion 162 includes a first portion 164 and a second portion 166 extending from first portion 164. Moreover, in the exemplary embodiment, second portion 166 is formed with a frusto-conical cross-sectional profile that is defined by a first diameter 163 at a first end 168 and a second diameter 165 at a second end 170. In the exemplary embodiment, first diameter 163 is larger than second diameter 165. In an alternative embodiment, second diameter 165 is greater than first diameter 163. In a further alternative embodiment, second portion 166 is formed with any suitable shape that enables support member 104 to function as described herein.

Moreover, in the exemplary embodiment, first diameter 163 of first end 168 is sized approximately the same as first diameter 143 of first end 144, and second diameter 165 of second end 170 is approximately the same size as the second diameter 145 of second end 146. In an alternative embodiment, the diameters are any suitable size to enable decoration assembly 100 to function as described herein.

In an alternative embodiment, support post 156 does not include coupling portion 162. In a further alternative embodiment, support post 156 does not include first portion 164, but rather includes only second portion 166.

In the exemplary embodiment, support post 156 includes an opening 169 defined within a sidewall 167 of support post 156. Opening 169 is a distance $D_2$ from second end 160. Moreover, in the exemplary embodiment, support post 156 is coupleable to an electricity source through an electrical connector assembly 171. Connector assembly 171 is positioned within support post cavity 161. In the exemplary embodiment, electric connector assembly 171 includes a wire 172 that extends between a first end 174 and a second end 176. Specifically, in the exemplary embodiment, wire first end 174 extends from support post first end 158, wire 172 is routed through a portion of cavity 161, and wire second end 176 extends through post opening 169. In the exemplary embodiment, first end 174 includes a female connector 178 that is sized and oriented to couple to connector 152, and second end 176 includes a male connector 182. In an alternative embodiment, first end 174 includes a male connector, and second end 176 includes a female connector.

Decoration assembly 100 also includes a base assembly 186 that is configured to couple to support post 156. In the exemplary embodiment, base assembly 186 includes a base 188, a support post 190 extending from base 188, and a retaining pin 192 sized for insertion within a portion of support post 190. In the exemplary embodiment, base 188 is a known "patio table umbrella base". Alternatively, base 188 may be any structure that enables decoration assembly 100 to function as described herein. In the exemplary embodiment, base 188 has a frusto-conical cross-sectional profile defined by a first diameter 193 at a first end 194 and a second diameter 195 at a second end 196. In the exemplary embodiment, first diameter 193 is smaller than second diameter 195. In an alternative embodiment, second diameter 195 is smaller than first diameter 193. In another alternative embodiment, base 188 has any suitable shape that enables decoration assembly 100 to function as described herein.

Support post 190 includes a first end 198, an opposite second end 200, and has a cavity 202 defined therein that extends from first end 198 to second end 200. In the exemplary embodiment, support post 190 also includes an opening 204 defined within a sidewall 203 that is sized and oriented to receive retaining pin 192. In the exemplary embodiment, retaining pin 192 includes a shaft 206 and a handle 208 extending from shaft 206.

In the exemplary embodiment, decoration assembly 100 includes a secondary support member 106 that is sized and shaped to substantially circumscribe support member 104. In the exemplary embodiment, support member 106 is a known "patio table". Alternatively, support member 106 may be any table configured to support tree 102 and member 104 as described herein. In a further alternative embodiment, support member 106 is not a table, but rather may be any item, such as but not limited to, a furniture item or a furniture accessory that enables decoration assembly 100 to function as described herein.

In the exemplary embodiment, support member 106 includes a means 302 for positioning support member 106 on the ground or other surface, and a table surface 304 attached thereto that includes at least one opening 316 defined therein. In the exemplary embodiment, opening 316 is sized to receive member 104 therein. Table surface 304 is oriented substantially horizontal, and is fabricated from any suitable material that enables decoration assembly 100 to function as described herein.

For example, support member 106 includes at least three legs 302 and table surface 304. Each leg 302 includes a first end 306 and an opposite second end 308, and tabic surface 304 includes an upper surface 310 and an opposite lower surface 312. In the exemplary embodiment, each leg first end 306 is positioned in contact against lower surface 312 to support table surface 304, and each leg second end 308 is positioned against ground, deck, and/or floor.

In the exemplary embodiment, support member 106 also includes a reinforcing element 318 that couples to each leg 302. Reinforcing element 318 includes an opening 320 defined therein such that each leg 302 extends through a portion of opening 320. Reinforcing element 318 is configured to provide reinforcing support to member 106. In an alternative embodiment, support member 106 does not include reinforcing element 318.

During assembly of member 106, in the exemplary embodiment, reinforcing element 318 is coupled to legs 302, and leg first ends 306 are coupled to lower surface 312 of table surface 304.

During assembly of tree 102 and member 104, in the exemplary embodiment, each arm 114 of tree 102 is coupled to shaft 108 with at least one fastening mechanism 118 such that each arm 114 is rotatable between storage position 120 and display position 122. Once each arm 114 is coupled to shaft 108, wire 150 of assembly 148 is helically wrapped around at least a portion of shaft 108 and a portion of electric wire 150 is positioned within cavity 132 such that connector 152 extends beyond second end 130 of support member 104.

Moreover, during assembly of decoration assembly 100, in the exemplary embodiment, base assembly 186 is positioned on the ground (not shown), and support post 156 is positioned within reinforcing element opening 320 such that support post 156 is substantially perpendicular with respect to the ground and base assembly 186. Specifically, support post second end 160 is inserted within tubular member cavity 202. After insertion of support post 156 into base assembly 186, retaining pin 192 is rotated within opening 204 to substantially secure support post 156 in position within support post 190.

Once support post 156 is secured within support post 190, support member 104 is coupled to support post 156. Specifically, female connector 178 is coupled to male connector 152. Once connectors 152 and 178 are coupled together, support member 104 is inserted through member 106. Specifically, member 104 is inserted through opening 316 in table surface 304 of member 106. After insertion through opening 316, member 104 is fittingly and removably coupled to support post 156. In the exemplary embodiment, coupling portion 138 of support member 104 is positioned within cavity 161 of support post 156, and portion 136 is positioned within coupling portion 162. Specifically, end 130 is inserted into cavity 161 through end 158 such that portion 164 substantially circumscribes portion 136, and portion 166 substantially circumscribes portion 142. More specifically, first end 144 is substantially aligned with first end 168, and second end 146 is substantially aligned with end 170. In the exemplary embodiment, support member 104 may be rotated with in support post 156.

Once tree 102, member 104, support post 156, and base assembly 186 are coupled together, male connector 182 may be inserted into at least one or but not limited to, an electrical outlet (not shown), a power strip, an extension cord, and/or any combination thereof to supply electricity to light-emitting devices 126.

Moreover, in an alternative embodiment, during assembly of decoration assembly 100, base assembly 186 is positioned on the ground (not shown). Once base assembly 186 is positioned on the ground, support post 156 is inserted through member 106. Specifically, post 156 is inserted through opening 316 in table surface 304 such that support post 156 extends from upper surface 310 to lower surface 312. In the alternative embodiment, coupling portion 162 extends above upper surface 310. Once support post 156 is positioned within opening 316, support post 156 is coupled to post 190. Specifically, support post end 190 is positioned within cavity 202.

In the alternative embodiment, after coupling post 156 to post 190, female connector 178 is coupled to male connector 152. Once connectors 152 and 178 are coupled together, support member 104 is fittingly and removably coupled to support post 156. Coupling portion 138 of support member 104 is positioned within cavity 161 of support post 156, and portion 136 is positioned within coupling portion 162. Specifically, end 130 is inserted into cavity 161 through end 158 such that portion 164 substantially circumscribes portion 136, and portion 166 substantially circumscribes portion 142. More specifically, first end 144 is substantially aligned with first end 168, and second end 146 is substantially aligned with end 170. In the exemplary embodiment, support member 104 may be rotated with in support post 156.

In the alternative embodiment, once tree 102, member 104, support post 156, and base assembly 186 are coupled together, male connector 182 may be inserted into at least one of, but not limited to, an electrical outlet (not shown), a power strip, an extension cord, and/or any combination thereof to supply electricity to light-emitting devices 126.

During use, a user (not shown) may rotate arms 114 of tree 102 between storage position 120 and display position 122. In the exemplary embodiment, to rotate arms 114 between position 120 and position 122, a user rotates each arm 114 in a downward direction 322 (shown in FIG. 4). In an alternative embodiment, a user may rotate each arm 114 in an upward direction (not shown).

The above-described apparatus and method provide a decoration assembly. The decoration assembly may include a secondary support member wherein a tree and a support member are fittingly coupled to the secondary support member. The tree and support member may be removed from the secondary support member for storage purposes. The secondary support member, which may be configured in many different ways, may be adapted for other purposes when the tree and support member are separated from the secondary support member. The decoration assembly described herein is flexible and easy to transport. The decoration assembly is also easy to assemble. Moreover, the decoration assembly has improved stability with the use of a secondary support member.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Exemplary embodiments of an apparatus and method of constructing a decoration assembly are described above in detail. The decoration assembly and methods illustrated are not limited to the specific embodiments described herein, but rather, components of the apparatus may be utilized independently and separately from other components described herein. Further, steps described in the method may be utilized independently and separately from other steps described herein.

While the invention has been described in terms of various specific embodiments, those skilled in the art will recognize that the invention can be practiced with modification within the spirit and scope of the claims.

What is claimed is:

1. A decoration assembly comprising:

an artificial tree comprising a plurality of arms, wherein each said arm is independently rotatable from a storage position to an erect position;

a support member coupled to said tree, said support member comprising:

an interior surface and an opposite exterior surface, said interior surface defines a cavity within said support member, and an electrical distribution system configured to be positioned within a portion of said cavity;

a secondary support member comprising a table surface, comprising an opening extending there through, and at least three legs coupled to said table surface, said support member configured to extend through said opening such that said secondary support member substantially circumscribes said support member; and a support post coupled to said support member, said support post comprising a first portion and a second portion extending from said first portion, said second portion having a substantially frusto-conical cross-sectional profile.

2. A decoration assembly in accordance with claim 1 wherein said tree comprises a lateral shaft comprising a first end and an opposing second end, a plurality of arms extend outward from said shaft, said plurality of arms are spaced axially along said shaft.

3. A decoration assembly in accordance with claim 2 further comprising at least one fastening mechanism configured to couple each of said plurality of arms to said shaft, said at least one fastening mechanism enables each of said plurality, of arms to rotate between an erect position and a storage position.

4. A decoration assembly in accordance with claim 1 wherein said support member further comprises a transition portion, a coupling portion, and a stop portion extending therebetween.

5. A decoration assembly in accordance with claim 4 wherein a portion of said stop portion has a frusto-conical cross-sectional profile defined by a first diameter at a first end and a second diameter at a second end.

6. A decoration assembly in accordance with claim 1 wherein said decoration assembly further comprises a base assembly configured to couple to said support post.

7. A decoration assembly in accordance with claim 1 wherein said electrical distribution system comprises an electrical connector assembly comprising a first wire comprising at least one male connector, said support post comprises a second wire comprising a male and female connector, said first wire male member is configured to couple to said second wire female member.

8. A method of assembly comprising:

providing an artificial tree comprising a plurality of arms, wherein each arm is independently rotatable from a storage position to an erect position;

coupling a support member to the tree, the support member includes an interior surface and an opposite exterior surface wherein a cavity is defined within said support structure;

positioning an electrical distribution system within a portion of the cavity;

coupling a secondary support member including a table surface including an opening extending therethrough, and at least three legs coupled to the table surface, to a portion of the support member such that the support member extends through the opening and secondary support member substantially circumscribes the support member; and coupling a support post to the support member, wherein the support post includes a first portion and a second portion that extends from the first portion and that has a substantially frusto-conical cross-sectional profile.

9. A method in accordance with claim 8 wherein the tree comprises a lateral shaft having a first end and an opposing second end, said method further comprising coupling a plurality of arms to the shaft such that each arm extends outwardly from the shaft, each arm is spaced axially along the shaft.

10. A method in accordance with claim 9 further comprising coupling each arm to the shaft using at least one fastening mechanism wherein the fastening mechanism enables each of the plurality of arms to rotate between an erect position and a storage position.

11. A method in accordance with claim 8 further comprising fabricating the support member with a transition portion, a coupling portion, and a stop portion extending therebetween.

12. A method in accordance with claim 11 further comprising fabricating the support member with a transition member, wherein at least a portion of the transition member has a frusto-conical cross-sectional profile defined by a first diameter at a first end and a second diameter at a second end.

13. A method in accordance with claim 8 wherein the electrical distribution system comprises a first wire having a male member, said method further comprising positioning a second wire including a male and female member within the support post.

14. A method in accordance with claim 13 further comprises coupling the first wire male member to the second wire female member.

15. A method in accordance with claim 13 further comprising coupling a base assembly to the support post.

* * * * *